US005114013A

United States Patent [19]

Brown et al.

[11] Patent Number: 5,114,013

[45] Date of Patent: May 19, 1992

[54] CARTON WITH COATED RECLOSABLE POURING OPENING

[75] Inventors: Arnold Brown, Owings Mills; Edward J. Giblin, Finksburg, both of Md.

[73] Assignee: Lever Brothers Company, Division of CONOPCO, Inc., New York, N.Y.

[21] Appl. No.: 506,978

[22] Filed: Apr. 9, 1990

[51] Int. Cl.[5] ..... B65D 5/70

[52] U.S. Cl. ..... 229/216; 229/221

[58] Field of Search ..... 206/621.2, 621.3, 621.4, 206/621.6, 621.7, 626

[56] References Cited

U.S. PATENT DOCUMENTS

| | | | |
|---|---|---|---|
| 1,539,985 | 6/1925 | Allen | 206/621.4 |
| 2,246,755 | 6/1941 | Reiter | 206/621.7 |
| 2,352,424 | 6/1944 | DeRieg | 206/621.7 |
| 3,438,565 | 4/1969 | Lugt et al. | 206/621.7 |
| 3,549,079 | 12/1970 | Northup | 206/621.4 |
| 3,563,447 | 2/1971 | Katzenmeyer | 206/621.4 |
| 3,971,506 | 7/1976 | Roenna | 206/626 |
| 4,142,635 | 3/1979 | Capo et al. | 206/621.7 |
| 4,194,677 | 3/1980 | Wysocki | 206/621.4 |
| 4,569,443 | 2/1986 | Roccaforte | 206/621.3 |
| 4,650,078 | 3/1987 | Desmond | 206/626 |
| 4,732,315 | 3/1988 | Gunn | 229/125.09 |

FOREIGN PATENT DOCUMENTS

| | | | |
|---|---|---|---|
| 546884 | 10/1957 | Canada | 206/621.3 |
| 2912717 | 10/1980 | Fed. Rep. of Germany | 206/626 |
| 925975 | 5/1963 | United Kingdom | 206/621.3 |
| 1203772 | 9/1970 | United Kingdom | 206/621.3 |
| 2045723 | 11/1980 | United Kingdom | 206/621.3 |

*Primary Examiner*—Gary E. Elkins

*Attorney, Agent, or Firm*—Ronald A. Koatz

[57] ABSTRACT

This invention relates to a reclosable sealing carton with a thin polymeric coating. The package is characterized by an extended glue flap scored with a cut-out adapted to form a plug when adhered to the underside of a closure flap and a closure flap overlying the glue flap cut-out of the material of the closure flap. When the consumer opens the closure flap, the cut-out in the glue flap adheres to the closure flap thereby forming a reclosable plug. The closure also comprises a thin, top coating applied to the closure to provide increased durability and resistance to wet handling. The reclosable flap may further comprise a tab facilitating ease of lifting the closing and a recess cut-out of the side panel overlying the glue flap also facilitating ease of lifting.

9 Claims, 3 Drawing Sheets

CARTON WITH COATED RECLOSABLE POURING OPENING

BACKGROUND OF THE INVENTION

Powdered laundry detergents have typically been provided in cartons fabricated from paperboard. Generally, such cartons are provided with die-cut perforations in the paperboard along which the consumer makes an opening in the carton.

Once these perforations are ruptured and an opening made in the carton, the large and irregular shape of the aperture formed makes it difficult to control the product during pouring. Furthermore, openings in the paperboard are not reclosable to a satisfactory degree. As a result, a tendency exists for the product to spill undesirably from the carton if tipped, and especially during transport. Moreover, products which are sensitive to moisture pick-up tend to cake because of the exposed opening.

One attempt to provide a solution to this problem has been to provide a metal spout which in use is a hinged, three-sided structure mounted on a carton sidewall. These are difficult to seal initially for shipment, are generally not well adapted to dispensing of large usage amounts for products such as laundry detergent granules or the like and are expensive to manufacture and apply to cartons.

Another attempt to solve the aforementioned problems has involved the use of plastic. Plastic fitments have been prepared which can be adhesively attached to the carton. It is generally desirable for detergent manufacturers that the fitment be affixed when the paperboard carton is in a flat, tubular form prior to erection of the carton. However, according to Gunn U.S. Pat. No. 4,732,315, when a thin, plastic fitment is affixed to the carton in its flat, tubular form problems may arise during stacking of the tubes due to an imbalance in the otherwise flat cartons caused by the extra thickness of the fitment. Gunn discloses a plastic closure device having an aperture configured in a pentagonal, "home plate" shape said to have rounded corners, which is balanced by means integral with the carton. For instance, the means may comprise score lines which are thickened to offset the extra thickness of the fitment. The tapered pointed end of Gunn's fitment is said to assist in properly directing the product stream.

Further disadvantages attendant to the use of plastic fitments in general are environmental problems due to the non-biodegradability of these materials. More importantly, the plastic component interferes with the recyclability of the paperboard carton after consumer use.

U.S. Pat. No. 4,650,078 to Desmond et al. discloses a closure in which a plug is attached to the underside of an external hinged flap side section. When the hinge flap side section is pulled away from a side wall panel, the plug attached to the side section disengages from a minor side wall panel to provide an opening in the side wall panel.

The Desmond et al. closure is a "push-in" friction fit type closure which is subject to opening undesirably. Moreover, no provision is made to facilitate grasping of the closure by the consumer. In addition, since the Desmond et al. design features only a partial height side section, there may be uneven roll-down which can further cause imbalance on stacking and there may be less strength added to the erect carton than if the side section were full height.

It is known in the art to use an extended glue panel behind a side panel and to include an opening in both the side and glue panels (see, for example, U.S. Pat. No. 3,549,079). No closure flap appears to be disclosed by this reference.

U.S. Pat. No. 3,563,447 (Katzenmeyer) teaches a carton in which removable material may be disengaged from a panel to which it is initially secured and then re-engaged into the recess left by the material removed. The resealable closure is on one panel and uses a different configuration than that of the invention. Namely, the Katzenmeyer closure is hinged along the vertical score on the side of the carton, and features a relatively small, off-centered, "racetrack-shaped" opening. Moreover, the tuck-in tab feature does not utilize the opening itself, but rather the tab feature is separate and positioned between the hinge and the opening. It is a critical feature of this design that the inside panel be extended only one-half the distance across the sidewall so that the tuck-in tab can function.

U.S. Pat. No. 4,142,635 (Capo et al.) also involves a different fitment. The carton described is folded differently than any other detergent carton now in use (e.g., top panel 17 and bottom panel 11 are normally sidewalls). Changeover to this design would involve major machine modifications for any manufacturer.

Additionally, the Capo, et al. closure on an erected carton would involve a top opening construction which would be difficult to seal adhesively at high speeds in a production operation. Besides the need for precise adhesive application around the opening, separate equipment would be needed to seal the side panel pieces which consist of four thicknesses. This would probably result in increased downtime and increased scrap due to an increased frequency of poor quality seals.

None of these patents show a combination of a novel, reclosable pouring opening as described below in which the closure has been coated with a thin protective polymeric coating.

Thus, it would be extremely desirable to find a carton which provides a secure novel closure not made of metal or of plastic, which can be securely resealed quite readily, which does not cause imbalance on stacking, which can be made more economically than prior art cartons, which can be easily sealed with existing equipment a high speeds, and to which has been added a thin polymeric coating to protect the closure from wetness and extend the useful life of the closure.

SUMMARY OF THE INVENTION

The invention provides a readily resealable closure which may be made entirely from paperboard. More particularly, the invention provides a dispensing package in which a resealable, coated closure is provided by:

(a) a closure flap which is cut from the side panel of the carton overlying a glue flap of which the glue flap is extended the full width of the side panel; and (b) a cut out in a portion of the extended glue flap underlying the closure flap of which the cut out is adhered to the closure flap so that the cut out in the glue flap becomes a plug when the closure flap is opened and reclosed;

wherein said closure is coated with a thin, water-resistant, durability-enhancing polymeric coating.

The polymeric coating protects the closure top from wetness during handling and provides greater durability when the closure is used repeatedly. The polymeric coating can be applied as a wax based hot melt of any copolymer or polymer known in the art of hot melt processing, a water emulsion of any copolymer or polymer known in the art of emulsion processing or a water or solvent-based coating. One copolymer with particularly desirable properties of water resistance, impact resistance and glossiness is styrene/acrylic polymer applied as an emulsion in water.

The closure flap may also characterized by a tab which is scored at the base and which can be bent at the base and tucked into the cut-out in the extended glue flap.

In a preferred embodiment, the side panel overlying the extended glue flap has an additional cut-out extending from the bottom of the tab on the closure flap. This cut-out allows the consumer more readily to grab the tab and to remove the cut-out from the glue panel which will become the plug.

In another embodiment, the flap may also have a series of perforations alternating with connecting bridges descending on opposite sides of the closure flap. Once the flap is opened, the bridge remnants may be designed to engage the side panel in order to close the flap more securely.

DETAILED DESCRIPTION OF THE INVENTIONS

Figure 1:
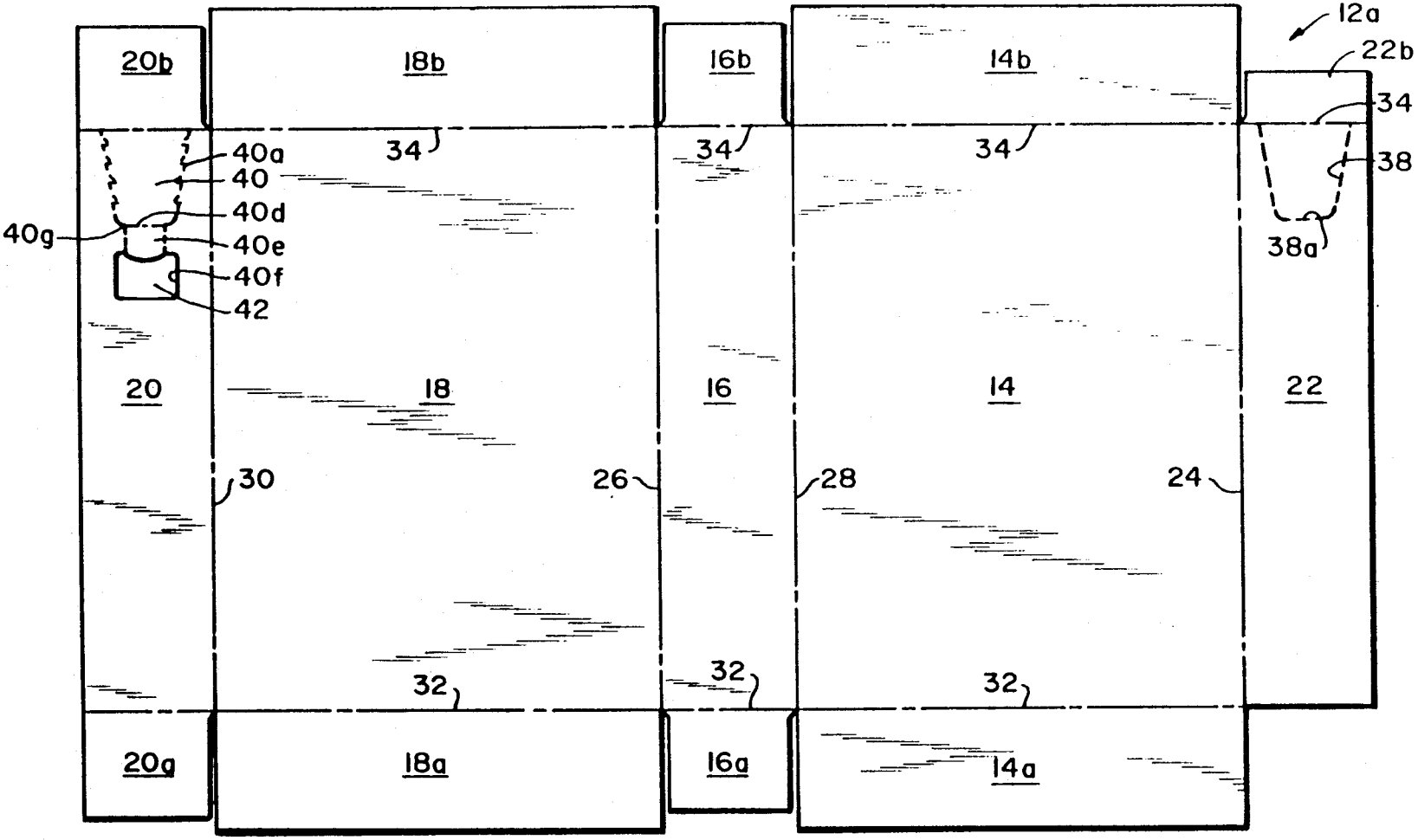
FIG. 1 is a plan view of the top, outside surface of a blank of foldable sheet material from which the carton of the invention may be formed.

Referring now to FIG. 1, the carton 12 is made from a carton blank 12*a*, which is printed, cut and scored to result in a carton of the correct size and configuration. The body of the blank 12*a* comprises integrally connected, alternating, rectangular face and side panels 14, 16, 18 and 20, respectively, and extended glue flap 22. A score line 24 separates glue flap 22 from face panel 14 and score line 26 separates side panel 16 from face panel 18. Unfolded scores 24, 26 can typically be made with a 3 point rule, which has a thickness of about 1.07 mm (0.042"), when the cartonboard has a 27 point caliper, which is approximately 0.69 mm (0.027") thick. While standards will vary to some extent, it is common in the carton manufacturing industry for scorelines for cartonboard having a thickness of 0.51 mm (0.020") or less to be made with 2 point rules, for thicknesses in the range of 0.56 mm (0.022") to 0.71 mm (0.028") with 3 point rules and thicknesses greater than that with 4 point rules. These guidelines produce scorelines which facilitate the accurate folding necessary to produce cartons closely adhering to precise size requirements, without undue damage to the cartonboard.

Score line 28 separates face panel 14 and side panel 16 and score line 30 separates face panel 18 and side panel 20. In order to form a sleeve of rectangular cross section, face panels 14 and 18 are similarly sized, as are side panels 16 and 20.

The lower extremities of the face and side panels 14, 16, 18 and 20 have lower flaps 14*a*, 16*a*, 18*a* and 20*a* integrally extending therefrom, the panels and flaps being separated by a latitudinal score line 32. The upper extremities of face and side panels 14, 16, 18 and 20 have top flaps 14*b* (inner major flap), 16*b*, 18*b* (outer major flap), 20*b*, all integrally extending therefrom, the panels and flaps being separated by latitudinal score line 34. Likewise, score line 34 separates the upper extremity of glue panel 22 from flap 22*b*. The lower flaps 14*a*, 16*a*, 18*a* and 20*a* can be of any suitable design for providing a sift-proof seal at the bottom of the resulting carton 12 in use. As shown, the flaps 14*a*, 16*a*, 18*a* and 20*a* are of standard commercial design and are adapted to be inwardly folded and adhesively sealed in overlapping relation on the carton.

It should be noted that, in its final configuration, side-panel 20 folds inwardly and is adhesively sealed over glue flap 22 such that both panel 20 and glue flap 22 form a side panel corresponding to the opposite side panel 16. It will also be noted that glue flap 22 is nearly the same width as side panel 20, in contrast to the usual glue flap which is much narrower than the side panel to which it is adhered.

Top flaps 14*b*, 16*b*, 18*b*, and 20*b* are also adapted to be inwardly folded and adhesively sealed in overlapping relation. Since the glue flap 22 has a top flap 22*b* attached, when the carton is closed top flap 20*b* will fold over top flap 22*b* in the same way in which side panel 20 folds over glue flap 22.

For best results, inner major flap 14*b* and outer major flap 18*b* should have a width which is substantially equal to the width of the side panels 16 and 20 (i.e., the dimension between scores 26 and 28 and between score 30 and the adjacent cut edge 36 of the blank 12*a*) and lengths substantially equal to the widths of face panels 14 and 18, respectively. Thus, the major flaps 14*b* and 18*b* are sized to cover the entire end of the carton 12 when sealing is effected following squaring and filling. Side flaps 16*b* and 20*b* can have a width which preferably does not exceed that of the major flaps 14*b*, 18*b*, in order to avoid inefficient use of carton board. As shown, the width of side flaps 20*b*, and 16*b* are about seven-eights that of major flaps 14*b*, 18*b*, 22*b* is about one-half the width of 14*b*. These dimensions are not critical and can be varied, as desired, within practical ranges.

Glue flap 22 has a cut-out 38 therein adjacent score 34 which divides the top flap 22*b* and the glue flap panel 22 and cut-out 38 is generally centrally located, widthwise within the glue flap 22. The cut-out illustrated has a generally upright U-shaped configuration wherein the base of this U-shape is closed by straight line 38*a*. For cartons of rectangular cross section measuring approximately 2⅜ inches by 11 inches the cut-out can conveniently have a width across its widest point of 1 5/16 inches and a base 38*a* 9/16 inches in width. It will be understood that these dimensions may be varied as required.

Extending downwardly from score 34 on side panel 20 and located generally centrally, widthwise, a closure flap 40 extending in length from score line 34 to a point 40*f* at the bottom of tab 40*e* is cut-out from the material of side panel 20. Closure flap 40 overlies and is adhered to the upright U-shaped cut-out scored into glue flap 22. When the closure flap is lifted, the cut-out in the glue flap 22 is adhesively attached to the underside of the closure flap and forms a reclosable plug. The plug 38 is connected to flap 22*b*, and separated by scoreline 34.

It should be understood that the generally U-shaped plug configuration is merely a preferred embodiment of the invention and that other shapes may be appropriately used for the packages of the invention. However, the plug which is formed when the closure flap is lifted and the cut-out on the glue flap is adhesively attached to the underside of the closure flap will have the same shape as the cut-out from which it is formed and the plug is designed to fit therein.

Closure flap 40 in side panel 20 is defined by a pair of cut lines 40*a* which are mirror images of each other and extend downwardly and inwardly from score line 34 until they reach point 40*g*. At this point, the closure lines may continue downwardly, but in a straight direction, parallel to each other so as to form a tab 40*e*. Tab 40*e* terminates in a curved line 40*f*.

The subject invention also provides a clear polymeric based coating which is applied to the closure cover. The thin coating is not affected by water when touched by wet hands, and provides durability to the cover and hinge during repeated opening and reclosure by the consumer. The coating may be a wax-based hot melt, a water emulsion or a solvent-based coating (although this is less preferred for environmental reasons). Any polymer or copolymer such as is well known in the hot melt or water-emulsion art may be used when applying the hot melt or water emulsion. An especially preferred coating is a styrene/acrylic polymer in a water emulsion.

The coating may be applied in a generally rectangular shape as close to the top and side scores as practical. Generally, it is applied about 1/32" to ½" from the scores, preferably about 1/16" to ¼" and, most preferably, about ⅛" from the scores. The coating is also applied about ⅛" to ½", preferably ¼" below the bottom of the cut-out. An outline of the approximate area which would be covered by the coating in a preferred embodiment of the invention is defined by lines 50*a*, *b*, *c* and *d* in FIGS. 2 and 5. It should be noted that the coating is not applied to cut-out 42. The thin polymeric coating 50 as applied over the closure flap 40 can also be seen in FIG. 4.

In a preferred embodiment, a line 40*d* defining the top of tab 40*e* may be scored in order to allow the tab to be bent at the score line 40*d* and inserted into cut-out 38. In this preferred embodiment, small notches or slits 38*c* (see FIG. 5) are carved into the base of the cut-out extending just below points 40*g* on either side of line 40*d*. These slits give the base of the cut-out a little yield so that the tab can be more readily inserted in the tuck position and also allow the consumer to remove the tab more readily from the cut-out upon re-opening the closure. In this preferred embodiment, there may also be a scoreline 38*d* connecting the bottom points of these notches or slits.

In addition to closure flap 40 cut out of side panel 20, side panel 20 also may have a cut-out 42 extending downward from curved line 40*f* defining the bottom of tab 40*e*. The downward extension may vary and should be reasonably large enough to allow someone to grab the tab. The dimensions of the cut-out, however, are not critical. Cut-out 42 is substantially in the shape of a square, i.e., the width of the "square" cut-out being substantially the same as the length. Since there is no cut-out in glue flap 22 corresponding to cut-out 42 in underlying side panel 20, a square recession is defined when the carton blank is constructed to form the carton. This recession allows consumers to grasp more readily tab 40*e* and open the closure defined by closure flap 40, plug 41 and cut-out 38.

In another preferred embodiment, the flap may have a series of perforations 40*a* alternating with connecting bridges descending on opposite sides of closure flap 40. Once opened, the bridge remnants 28*d* may be designed to engage one another (FIG. 5) in the side panel and form a more secure fit when the closure flap is closed.

The carton blank 12*a* when face down is formed into a carton sleeve in flattened tubular form by applying adhesive to the upper face of glue flap 22, folding glue flap 22 and face panel 14 as a unit upwardly 180° along score line 28, and folding side panel 20 upwardly 180° along score line 30 to contact and overlap glue flap 22, thereby becoming adhesively united therewith.

In the usual case with standard seal end cartons, the cartons are processed by the carton manufacturer to adjust the thickness of the outer scores of the folded carton to match generally the thickness of the folded carton at the glue seam. (At the glue seam there are normally three thicknesses of cartonboard, while at the outer scores there are only two). The thickness of the outer scores is adjustable by the wheels on the manufacturer's carton side seam gluer and can, for example, have rolled-down working scores that are thicker or thinner than the glue seam area which has three-board thickness. Preferably, to avoid carton feed problems, the thickness of the outer scores of the carton should be controlled so that they are not more or less than the glue seam thickness by 0.0125 mm (0.005").

Figure 2:
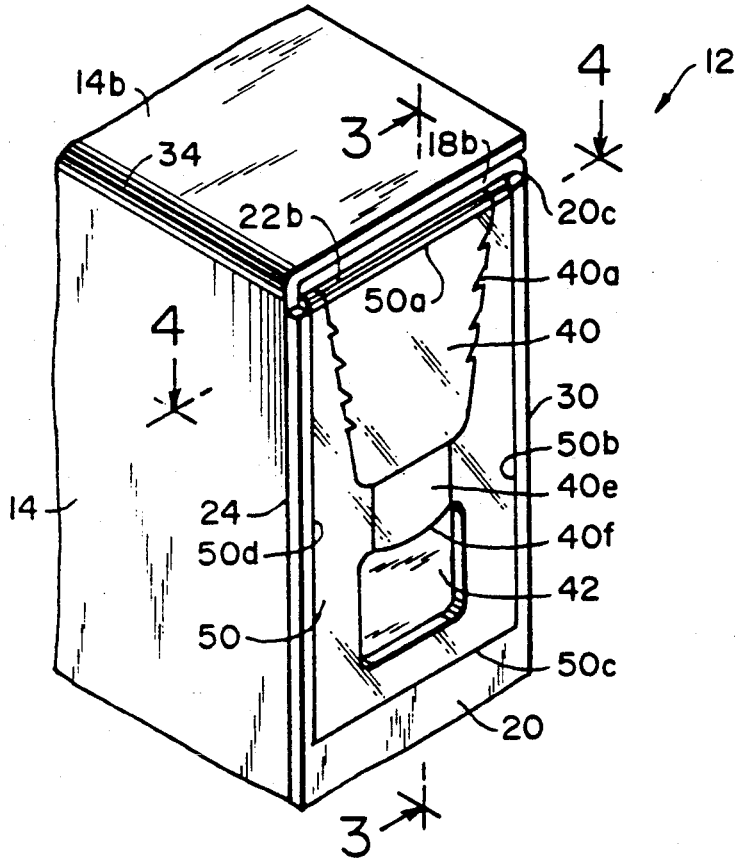
FIG. 2 is a fragmentary perspective view of an upper corner of the carton showing the closure flap in a "closed" position.

Referring now to FIG. 2, closure cover 40 of the assembled carton extends from folded side score 20*c* (which is connected to minor flap 20*b*) to curved line 40*f* defining the bottom of tab 40*e*. The cut-out in glue flap 22 is covered by closure cover 40 and cannot be seen. A substantially square recess 42 has been cut into side panel 20 and allows the consumer to grasp tab 40*e* at the point 40*f*, pull the flap up, lift the cut-out so that it adheres to the closure flap and thereby expose the cut-out from which the detergent may be dispensed. This figure shows perforations 40*a* which may be used to engage catches in the side panel when the closure is in a closed position.

It should be noted that since glue flap 22 extends the entire length of the carton and therefore has essentially the same length and width as side panel 20, when the carton is rolled down, the working score thickness will be more uniform and not cause the imbalance which might otherwise be caused if the working score were rolled down over a partial height, extended glue flap. In addition, the additional paperboard strengthens the erected carton, particularly for top board strength.

It is also an advantage of the invention that, since the orifice is cut-out of the glue flap and since the side panel 20 and top flap 20*b* form one integral piece (the cover member 40 being hinged to the top flap 20*b*), no additional gluing step is required to attach cover member 40 to the side panel as would be required if the cover member and top flap 20*b* were applied exterior to the side panel. Also, when cover member 40 is opened by the user, it will not be pulled away from the carton.

Figure 3:
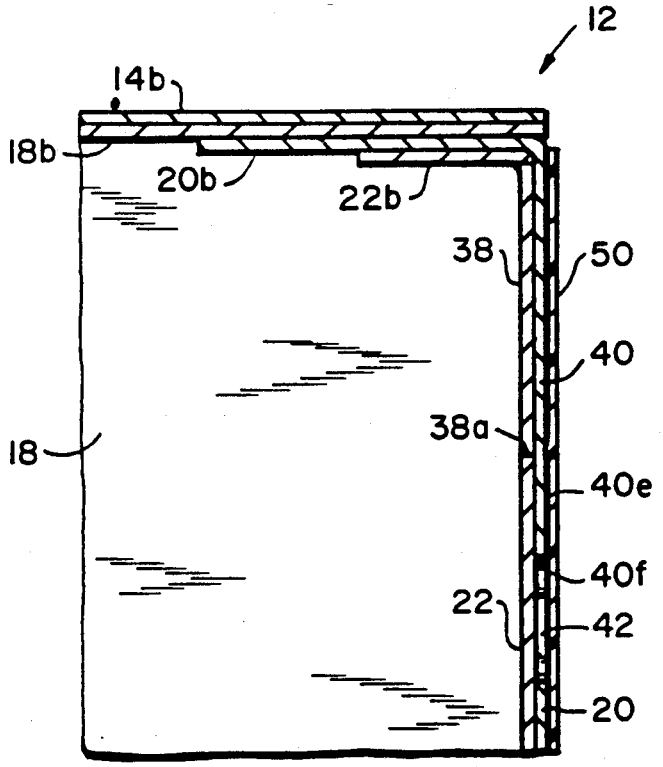
FIG. 3 is a sectional view taken along line 3—3 of FIG. 2.
Figure 4:
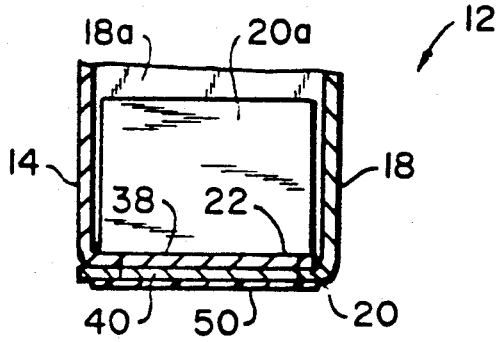
FIG. 4 is a sectional view taken along line 4—4 of FIG. 2.

Referring to FIG. 3, this figure represents a sectional view along line 3—3 of FIG. 2. Top flaps can be seen overlying one another in this figure and side panel 20 can be seen overlying glue flap 22. Similarly, FIG. 4 is a sectional view along line 4—4 of FIG. 2.

Figure 5:
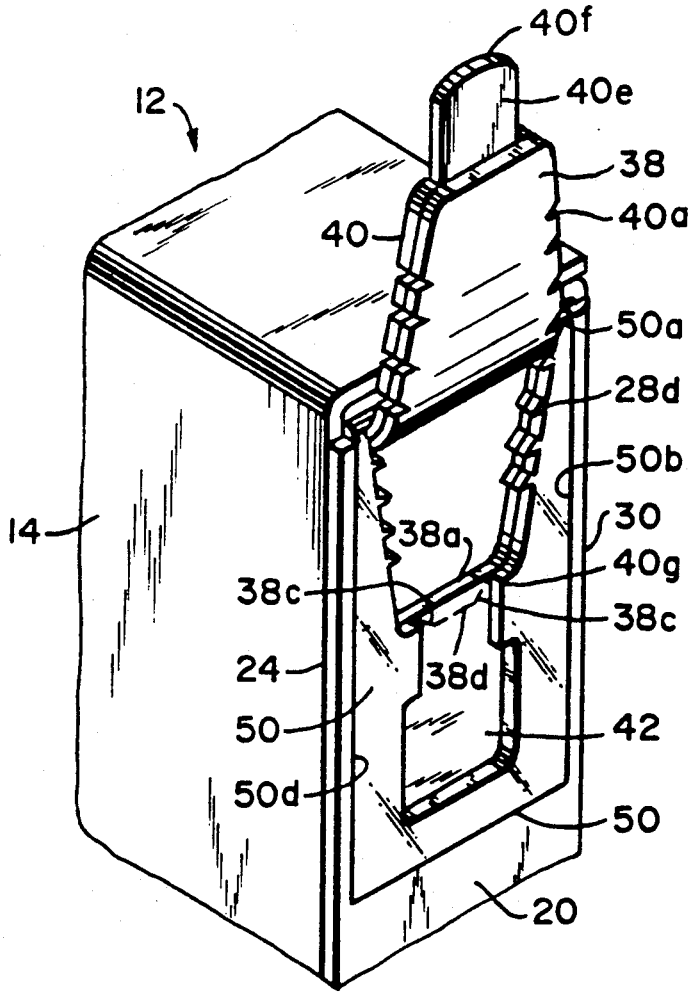
FIG. 5 is an enlarged fragmentary perspective view of the upper corner of the carton showing the closure flap in an "open" position.

In FIG. 5, closure 20 in the "open" position wherein tab 40*e* has been lifted and the plug has been disengaged from the cut-out in glue flap 22. Again, it is to be understood that the shape of the plug and cut-out may vary.

In a preferred embodiment of the invention, when the closure is in a closed position, the plug is engaged in the cut-out of the glue flap, tab 40*e* is bent at score line 40*d* and tab 40*e* is inserted into the cut-out.

Once having been opened and squared, carton 12 is made in the usual manner and the package interior is filled with the desired product, e.g. detergent granules. The top seal is then effected by folding side flaps 16*b*, 20*b* inwardly 90°, applying adhesive to both surfaces of inner major flap 18*b* inwardly to adhere it to the underlying inner major flap 14*b*. Top flap 22*b* is not sealed to any surface, and underlies top flap 20*b*. Any standard paperboard adhesive can be used.

While preferred embodiments of the present invention have been described and illustrated, it will be obvious to those skilled in the art that various changes and modifications can be made without departing from the spirit and scope of the invention. The terms used in describing the invention are used in their descriptive sense and not as terms of limitation. Accordingly, the following claims are intended to embrace such equivalent changes, modifications and applications which are within the scope of this invention.

We claim:

1. A reclosable dispensing package comprising:

a carton comprising integrally connected, alternating rectangular face and side panels and an extended glue flap underlying one of said panels;

a closure flap cut out of material of the side panel overlying the glue flap;

said glue flap having a cut-out adapted to adhesively attach to an underside of the closure flap and to form a reclosable plug having the same shape as the cut-out when the closure flap is lifted;

said closure flap characterized by a coating applied from about 1/32 inch to about ½ inch from the top and side scores of the closure flap in order to provide resistance to wet handling and increased durability.

2. The reclosable dispensing package according to claim 1, wherein the cut-out in the glue flap has a generally upright U-shaped configuration.

3. The reclosable dispensing package according to claim 1, wherein said closure flap further comprises a tab.

4. The reclosable dispensing packaging according to claim 1, wherein the side panel overlying the glue flap additionally comprises a cut-out.

5. The reclosable dispensing package according to claim 4, wherein the additional cut-out is substantially in the shape of a square.

6. The reclosable dispensing package according to claim 3, wherein the side panel overlying the glue flap additionally comprises a cut-out extending downwardly from a base of said tab.

7. The reclosable dispensing package according to claim 1, wherein the closure flap has a series of perforations and bridges descending on opposite sides of the closure flap.

8. The reclosable dispensing package according to claim 7, wherein said perforations engage a series of bridge remnants on the side panel when the closure flap is in a closed position.

9. A reclosable dispensing package according to claim 1 further comprising lower flaps integrally extending from the lower extremities of said face and side panels and top flaps integrally extending from the top extremities of said face and side panels and from said glue flap.

* * * * *